United States Patent [19]

Afshar

[11] Patent Number: 4,644,915

[45] Date of Patent: Feb. 24, 1987

[54] HEAT RETAINING COVER FOR INTERNAL-COMBUSTION ENGINE

[76] Inventor: Bahram Afshar, 3662 Salem Walk, #A1, Northbrook, Ill. 60062

[21] Appl. No.: 793,436

[22] Filed: Oct. 31, 1985

[51] Int. Cl.[4] ..... F02N 17/00; F02B 77/12

[52] U.S. Cl. ..... 123/142.5 R; 123/198 R

[58] Field of Search ..... 123/142.5 R, 142.5 E, 123/198 R

[56] References Cited

U.S. PATENT DOCUMENTS 2,404,394 7/1946 Miller ..... 123/142.5 R 2,417,636 3/1947 Ditzler ..... 123/142.5 R

FOREIGN PATENT DOCUMENTS 3133256 3/1983 Fed. Rep. of Germany ... 123/142.5 R

OTHER PUBLICATIONS

J. C. Whitney & Co., Catalog, 1983, p. 68, vinyl lined Mylar ® Faced foam insulation.

*Primary Examiner*—Ira S. Lazarus

[57] ABSTRACT

A heat-retaining cover for an internal-combustion engine, composed of a multi-layered flexible structure in the form of a blanket containing wind- and water-repellent material as an outer layer and at least one sub-layer of heat-insulation material, the whole forming a blanket to be placed over the engine before closing the vehicle hood. Attached to the blanket is a tell-tale device to be exposed outside the closed hood to alert the vehicle driver that the blanket is in place.

3 Claims, 4 Drawing Figures

Fig. 1
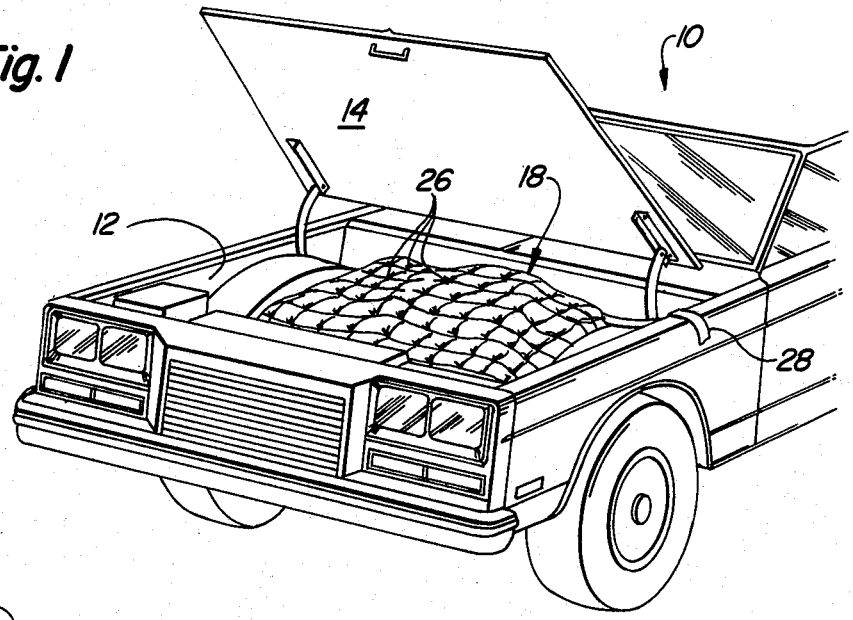
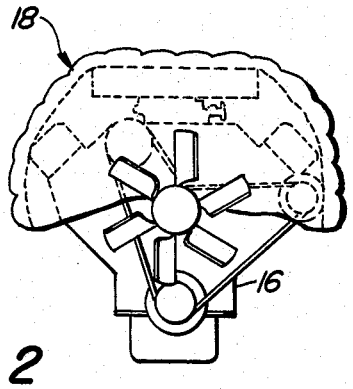
Fig. 2
Fig. 3
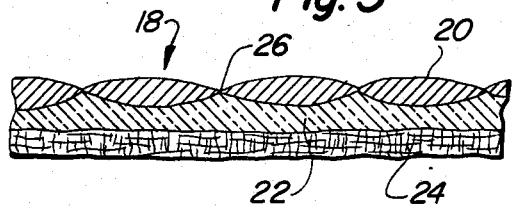
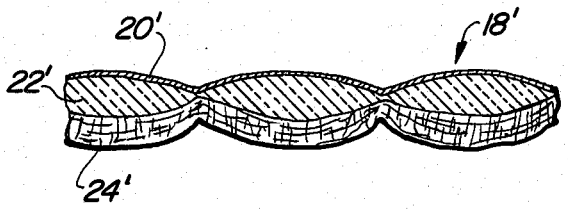
Fig. 4

HEAT RETAINING COVER FOR INTERNAL-COMBUSTION ENGINE

BACKGROUND AND SUMMARY OF THE INVENTION

Many forms of starting aids have been proposed over the past several years to facilitate the starting of internal-combustion engines in cold weather, ranging from electrically-energized block and oil heaters, heat lamps and the like, all required access to a source of electrical potential. These, in addition to be useless in the absence of electrical power, are cumbersome and expensive and likely to electrical and/or mechanical failure.

The present invention provides a simple, inexpensive blanket that is effective, convenient, easy to store and readily transportable in the vehicle truck or tonneau so as to be always available for use. The blanket features a multi-layered cover adapted to overlie the top and depend at least partly along the sides of an engine that is exposed via its open hood. After the cover is in place, the hood is closed to further augment the heat-retaining properties of the cover. A tell-tale member, attached to the blanket, is exposed externally of the closed hood to alert the driver to the presence of the cover.

The several layers of the cover include an outer or top layer of wind- and water-repellent material and at least one underlying or secondary layer of heat-insulative material. A third and innermost layer may be provided of soft, insulating material adapted to conform to irregularities in the engine top.

Further features and objects of the invention will become apparent as a preferred embodiment thereof is disclosed in detail herein.

DESCRIPTION OF THE DRAWINGS

FIG. 1 is a fragmentary perspective showing the inventive cover in use.

FIG. 2 is an end view showing the draped relationship of the cover to a typical engine.

FIG. 3 is an enlarged, fragmentary end view showing one form of multi-layered cover.

FIG. 4 is a similar view showing a second form of cover.

DETAILED DESCRIPTION OF A PREFERRED EMBODIMENT OF THE INVENTION

A representative automotive vehicle is designated at (10) as having a typical engine compartment (12) normally covered by a hood (14). FIG. 2 indicates at (16) an end elevation of a typical internal-combustion engine. Indicated generally by the numeral (18) is the improved cover or blanket according to that type of design shown primarily in FIG. 3 as a multi-layered structure comprising three layers (20), (22) and (24). The outer or top layer (20) is a material having wind- and water-repellent qualities, such as tightly-woven nylon or its equivalent, preferably quilted as at (26). The next underlying layer (22) is composed of material having good insulating qualities, such as polyester fibrous mat, while the third (and here innermost) layer is of a soft material commonly known as "acrylic fleece"; although, any equivalent materials may be substituted for the foregoing. The innermost layer is selected, for one reason, for its ability to conform substantially to the irregularities customarily represent in modern engines, thus enabling the cover to more closely "hug" the engine, at least over the top and partly down opposite sides.

In use, the blanket is used in covering relation to the engine which has just been shut down, for example, and the hood is, of course, opened for the purpose of blanketing the engine, after which the hood is closed to further augment the heat-retaining characteristics of the cover. In order to remind the driver that the blanket is in place, a tell-tale device (28) is attached to the rear left corner of the blanket and is allowed to hang out or be otherwise exposed at the driver's side of the vehicle.

A modified form of cover is shown in FIG. 4, wherein a blanket (18') is composed of three layers (20'), (22') and (24') and is quilted at (26'). In this case, the quilting goes through the three layers as a means of augmenting the affixation of the layers to one another. Any equivalent form of affixation, adhesion, etc., may be employed.

Experience has shown that the cover is efficient and effective, keeping the engine in startable condition despite cold winds and moisture. The blanket substantially "wraps" the engine and the closed hood prevents high winds from dislodging the cover. The size and weight of the product make for easy handling and storage, as in the vehicle's trunk or tonneau. Features and advantages other than those enumerated will readily occur to those versed in the art, as will many alterations in the preferred embodiments shown, all without departure from the spirit and scope of the invention.

I claim:

1. A heat retaining cover for use beneath the hood of a vehicle having an internal-combustion engine, comprising a multi-layered blanket of flexible nature adapted to overlie the top and depend at least partly along opposite sides of the engine, said blanket having an outer layer in the form of a sheet of wind- and water-repellent material, a secondary layer affixed to the underneath of the outer layer and composed primarily of heat insulating material and a third layer affixed to the underside of the secondary layer, said third layer composed of relatively soft material adapted generally to conform to irregularities in engine top surfaces.

2. The cover of claim 1, including a tell-tale attachment affixed to the cover and adapted to be exposed externally of the closed engine hood at the driver's side of the vehicle to signal the presence of the cover beneath the hood.

3. The cover of claim 1, wherein said third layer comprises acrylic fleece.

* * * * *